US008334470B2

(12) United States Patent
Sano

(10) Patent No.: US 8,334,470 B2
(45) Date of Patent: Dec. 18, 2012

(54) LEVER OPERATION DEVICE

(75) Inventor: Tadashi Sano, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 189 days.

(21) Appl. No.: 13/034,636

(22) Filed: Feb. 24, 2011

(65) Prior Publication Data

US 2011/0221551 A1 Sep. 15, 2011

(30) Foreign Application Priority Data

Mar. 11, 2010 (JP) ..... 2010-054858

(51) Int. Cl.
*H01H 3/16* (2006.01)
*H01H 9/00* (2006.01)

(52) U.S. Cl. ..... 200/61.27; 200/61.54; 335/205

(58) Field of Classification Search ..... 200/61.27, 200/61.54; 335/205–207
See application file for complete search history.

(56) References Cited

U.S. PATENT DOCUMENTS 5,861,594 A * 1/1999 Akimoto et al. ..... 200/61.54
6,873,233 B2 * 3/2005 Sugiyama et al. ..... 335/205
7,642,475 B2 * 1/2010 Urakawa et al. ..... 200/61.54
7,880,572 B2 * 2/2011 Ichimura ..... 335/205

FOREIGN PATENT DOCUMENTS

JP 2001-6494 1/2001

* cited by examiner

*Primary Examiner* — Ramon Barrera
(74) *Attorney, Agent, or Firm* — Beyer Law Group LLP

(57) ABSTRACT

A lever operation device includes a movable support member that supports a base portion of an operation lever such that the base portion is pivotable along a first operation plane, a housing that supports the movable support member such that the movable support member is pivotable along a second operation plane that is orthogonal to the first operation plane, an actuator holder attached to the base portion such that the actuator holder is rotatable along the second operation plane, a first actuator retained by the actuator holder, and a second actuator retained by the movable support member. The housing is provided with a first cam surface and a second cam surface on an inner wall surface thereof, the first actuator and the second actuator being in elastic contact with the first cam surface and the second cam surface, respectively.

4 Claims, 11 Drawing Sheets

LEVER OPERATION DEVICE

CLAIM OF PRIORITY

This application claims benefit of Japanese Patent Application No. 2010-054858 filed on Mar. 11, 2010, which is hereby incorporated by reference.

BACKGROUND OF THE INVENTION

1. Field of the Invention

The present invention relates to a lever operation device suitable for use as, for example, a turn signal switch device or a wiper switch device of an automobile.

2. Description of the Related Art

Lever operation devices used as turn signal switch devices or wiper switch devices of automobiles generally include a columnar operation lever that projects from a housing fixed to, for example, a steering column. The operation lever can be pivoted along two operation planes that are substantially orthogonal to each other. The operation lever is selectively operated along the individual operation planes, and a plurality of types of operation signals are output in accordance with the direction in which the operation lever is operated.

A known support structure of an operation lever in a lever operation device of this type includes a holder that supports a base portion of the operation lever such that the base portion is pivotable along a first operation plane; a first driver that is in elastic contact with a first cam surface provided on an inner back wall of the holder; a housing that supports the holder such that the holder is pivotable along a second operation plane that is substantially orthogonal to the first operation plane; a second driver that is in elastic contact with a second cam surface provided on an inner back wall of the housing; and detecting means capable of individually detecting the pivoting operations of the operation lever along the first and second operation planes, and the first and second drivers are arranged substantially on a single straight line (see, for example, Japanese Unexamined Patent Application Publication No. 2001-6494).

In the lever operation device according to the related art having the above-described structure, when a user operates the operation lever along the first operation plane, the operation lever pivots with respect to the holder and the housing. In response to this operation, the first driver slides along the first cam surface to generate a clicking sensation, and one of slide switches included in the detecting means is driven and turned on by the base portion of the operation lever. When the user operates the operation lever along the second operation plane, the operation lever pivots together with the holder with respect to the housing. In response to this operation, the second driver slides along the second cam surface to generate a clicking sensation, and the other one of the slide switches included in the detecting means is driven and turned on by the holder.

However, in the above-described lever operation device according to the related art, the first driver that is in elastic contact with the inner back wall of the holder and the second driver that is in elastic contact with the inner back wall of the housing are arranged substantially on a single straight line, so that a desired clicking sensation is generated when the operation lever is operated along the first or second operation plane. Accordingly, there is a problem that it is difficult to reduce the size of the support structure of the operation lever. In other words, according to the example of the related art, a mechanism for supporting the base portion of the operation lever such that desired operations can be performed is necessarily long in the depth direction. Thus, it is difficult to reduce the size of the lever operation device.

SUMMARY OF THE INVENTION

In view of the above-described circumstances of the related art, the present invention provides a lever operation device whose size can be reduced.

According to an aspect of the present invention, a lever operation device includes a movable support member that supports a base portion of an operation lever such that the base portion is pivotable along a first operation plane; a housing that supports the movable support member such that the movable support member is pivotable along a second operation plane, the second operation plane being substantially orthogonal to the first operation plane; an actuator holder attached to the base portion of the operation lever such that the actuator holder is rotatable along the second operation plane; a first actuator retained by the actuator holder with first elastic urging means provided therebetween; and a second actuator retained by the movable support member with second elastic urging means provided therebetween. The housing is provided with a first cam surface and a second cam surface, the first actuator and the second actuator being in elastic contact with the first cam surface and the second cam surface, respectively.

In the lever operation device having the above-described structure, the actuator holder and the movable support member retain the first actuator and the second actuator, respectively, the actuator holder being pivotally connected to the base portion of the operation lever. The first cam surface and the second cam surface, along which the actuators slide, are provided on the same face in the housing. Accordingly, the size of the lever operation device can be reduced by reducing the depth thereof. When the operation lever is pivoted along the first operation plane, the second actuator retained by the movable support member that does not move together with the base portion of the operation lever does not slide along the second cam surface, and only the first actuator retained by the actuator holder that moves together with the base portion of the operation lever slides along the first cam surface. When the operation lever is pivoted along the second operation plane, the first actuator does not slide along the first cam surface owing to the reaction force received from the first cam surface with which the first actuator is constantly in contact, and only the second actuator retained by the movable support member that moves together with the base portion of the operation lever slides along the second cam surface. Thus, the first cam surface and the second cam surface can be provided at different positions on the same face of the housing. With this structure, the clicking sensation (operation feeling) generated when the operation lever is operated along the first operation plane and the clicking sensation generated when the operation lever is operated along the second operation plane can be set along desired feeling curves without causing interference therebetween. Thus, a lever operation device having a good operation feeling can be provided.

The lever operation device may further include a first rotating member rotated by a first driving portion provided on the actuator holder; and a second rotating member rotated by a second driving portion provided on the movable support member. The first and second rotating members may have respective objects to be detected and be attached to the housing, and a circuit board on which detectors are mounted may be attached to the housing, the detectors facing the objects to be detected. In such a case, the space for the detection mechanism for detecting the operations of the operation lever along the first and second operation planes can be reduced, and the size of the lever operation device can be further reduced. In this case, the first and second driving portions may be gear portions, the objects to be detected may be permanent magnets, and the detectors may be magnetic sensors. In such a case, the information regarding the pivoting operation of the operation lever along the first and second operation planes can be accurately transmitted by the gear portions to the corresponding rotating members. Accordingly, the operation position of the operation lever can be detected extremely accurately by detecting variations in magnetic fields caused by variations in the rotational positions of permanent magnets with the magnetic sensors, the permanent magnets rotating together with the rotating members. Since the permanent magnets do not contact the magnetic sensors, the continuity failure due to abrasion or the like can be prevented and the life of the device can be increased.

In the above-described structure, the actuator holder may include a pair of attachment wall portions that face each other, and a first retaining portion that retains the first actuator, the first retaining portion projecting in a direction opposite to the attachment wall portions, and the attachment wall portions may be pivotally attached to the base portion of the operation lever. The movable support member may include a hollow frame body that surrounds the attachment wall portions of the actuator holder, and a second retaining portion that retains the second actuator, the second retaining portion projecting from the hollow frame body in the same direction as the direction in which the first retaining portion projects. One of two pairs of opposing wall portions of the frame body may be pivotally attached to the base portion of the operation lever, and the other one of the two pairs of opposing wall portions may be pivotally attached to the housing. In such a case, the structure of the lever operation device can be made simpler, and the size thereof can be further reduced.

DESCRIPTION OF THE PREFERRED EMBODIMENT

Figure 1:
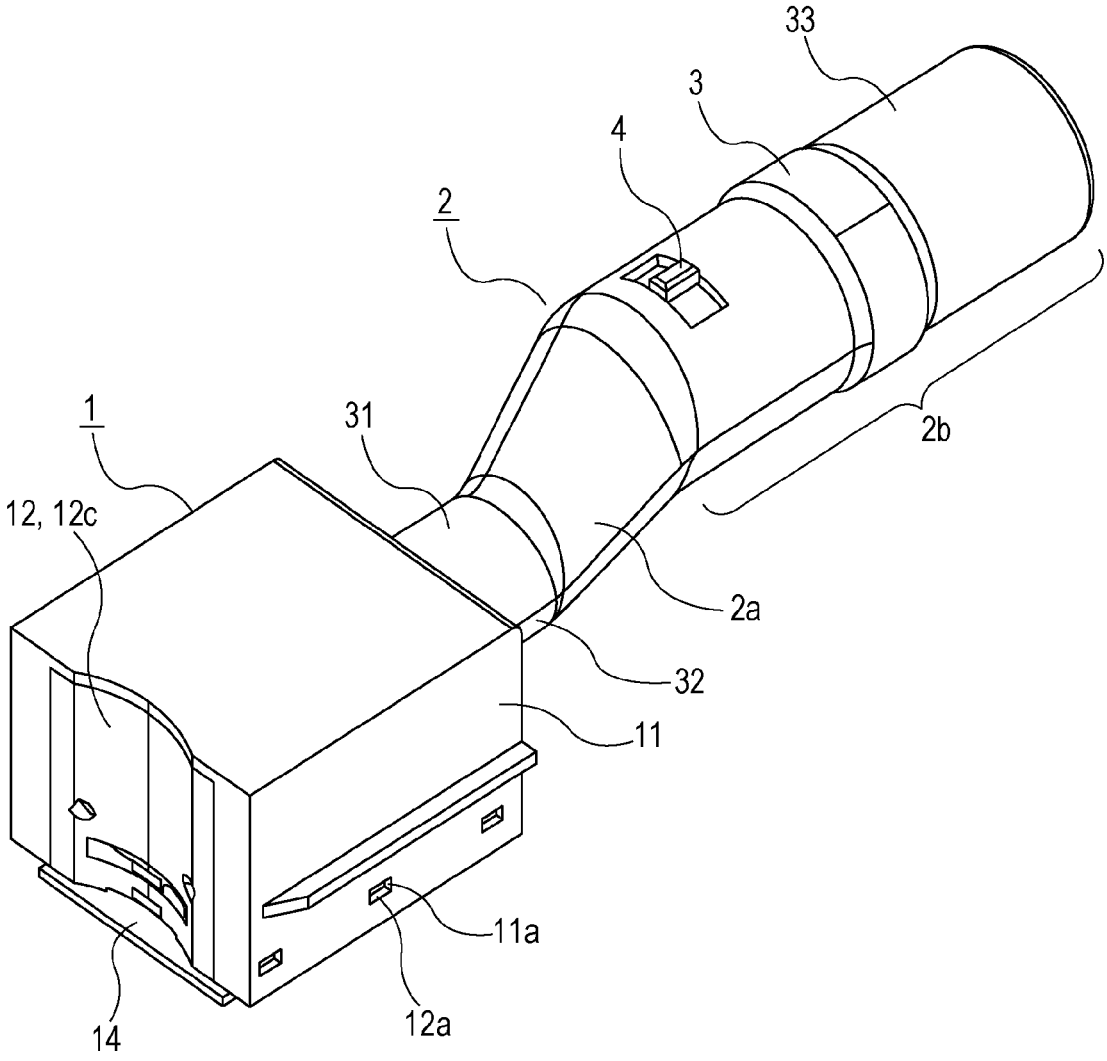
FIG. 1 is a perspective view of a lever operation device according to an embodiment of the present invention.

A lever operation device according to an embodiment of the present invention will be described with reference to FIGS. 1 to 15. The lever operation device is used as a turn signal switch device of an automobile. Referring to FIG. 1, the lever operation device includes a housing 1 fixed to, for example, a steering column (not shown) and an operation lever 2 that projects from the housing 1. The operation lever 2 can be pivoted along two orthogonal operation planes (first and second operation planes), and can be selectively operated along the individual operation planes. A plurality of operation members, such as a rotating knob 3 and a slide knob 4, are provided on the outer periphery of the operation lever 2. The operation members can be operated individually.

Figure 2:
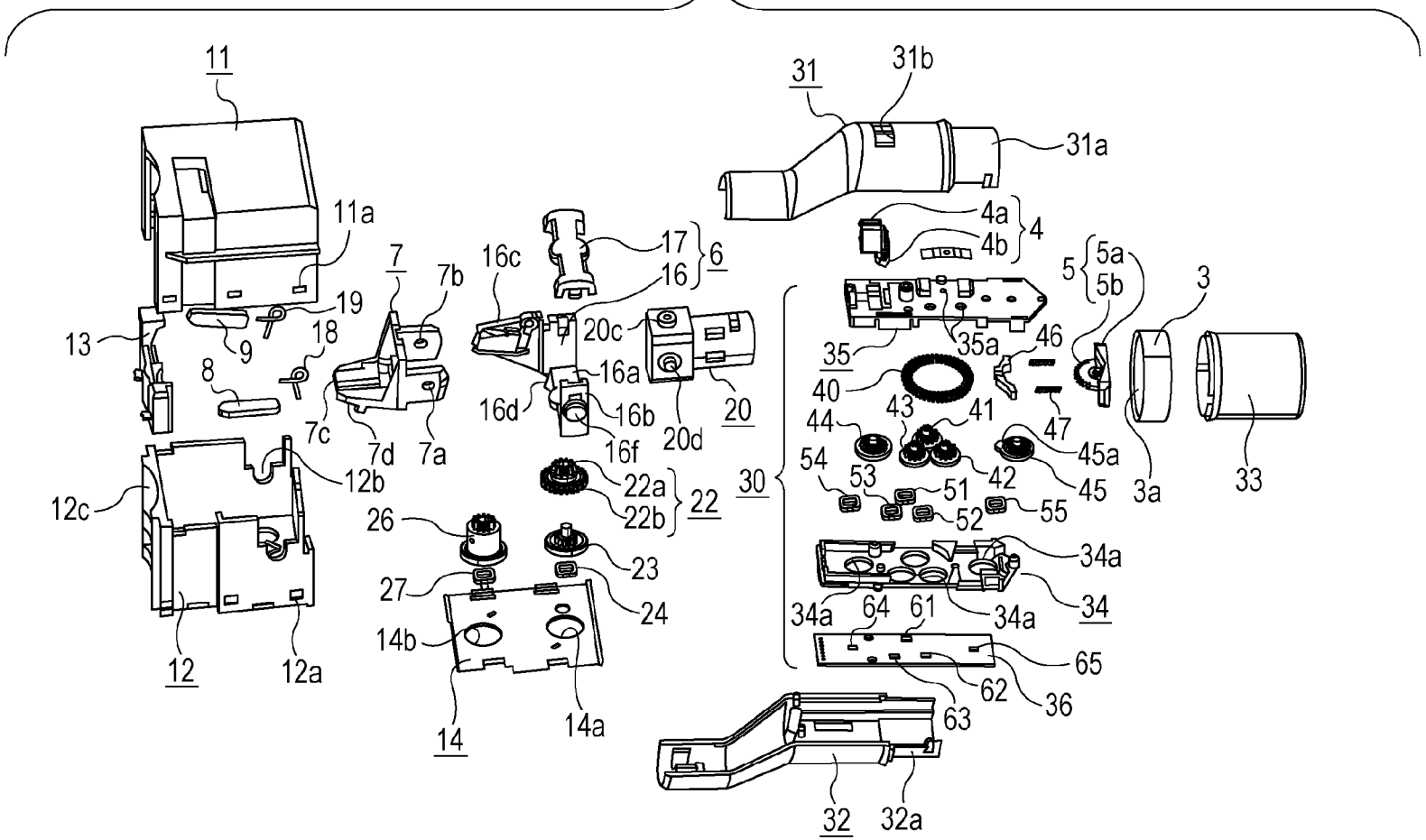
FIG. 2 is an exploded perspective view of the lever operation device.
Figure 3:
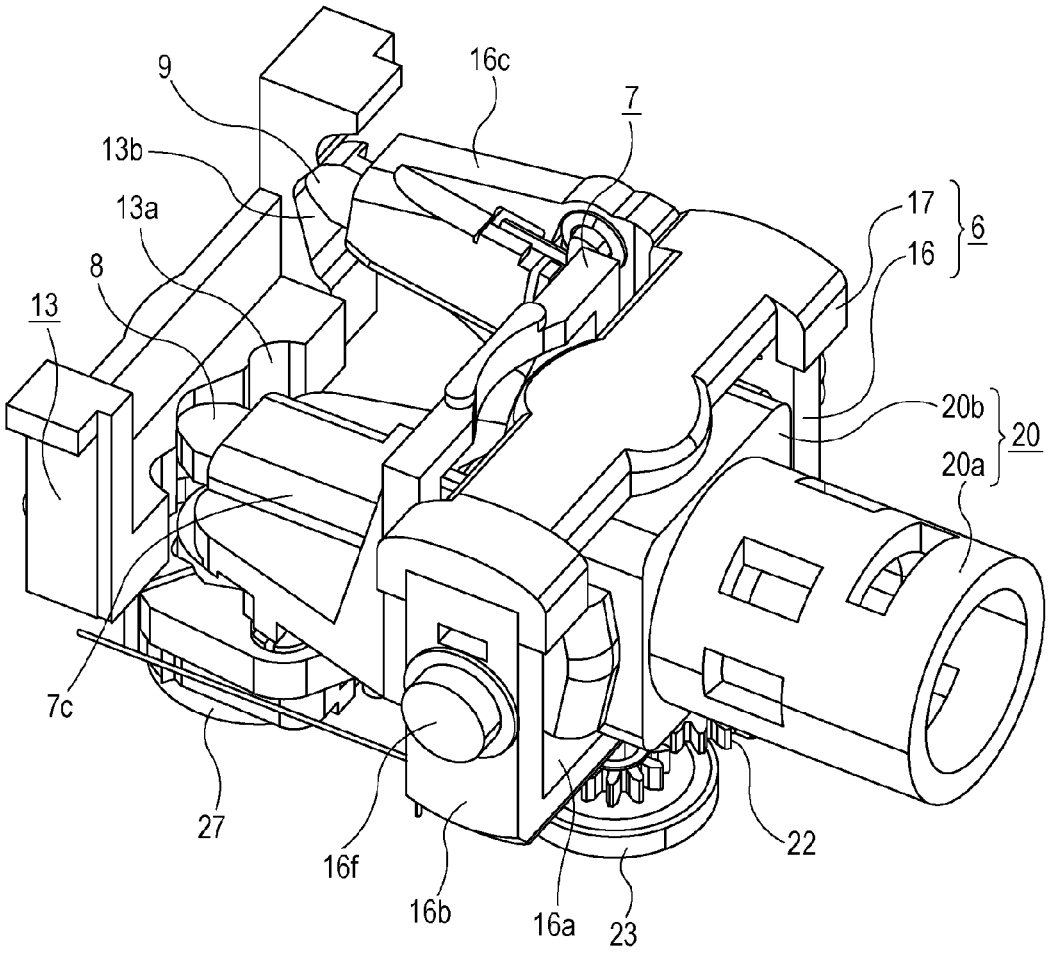
FIG. 3 is a perspective view of a support mechanism that supports a base portion of an operation lever in the lever operation device.
Figure 5:
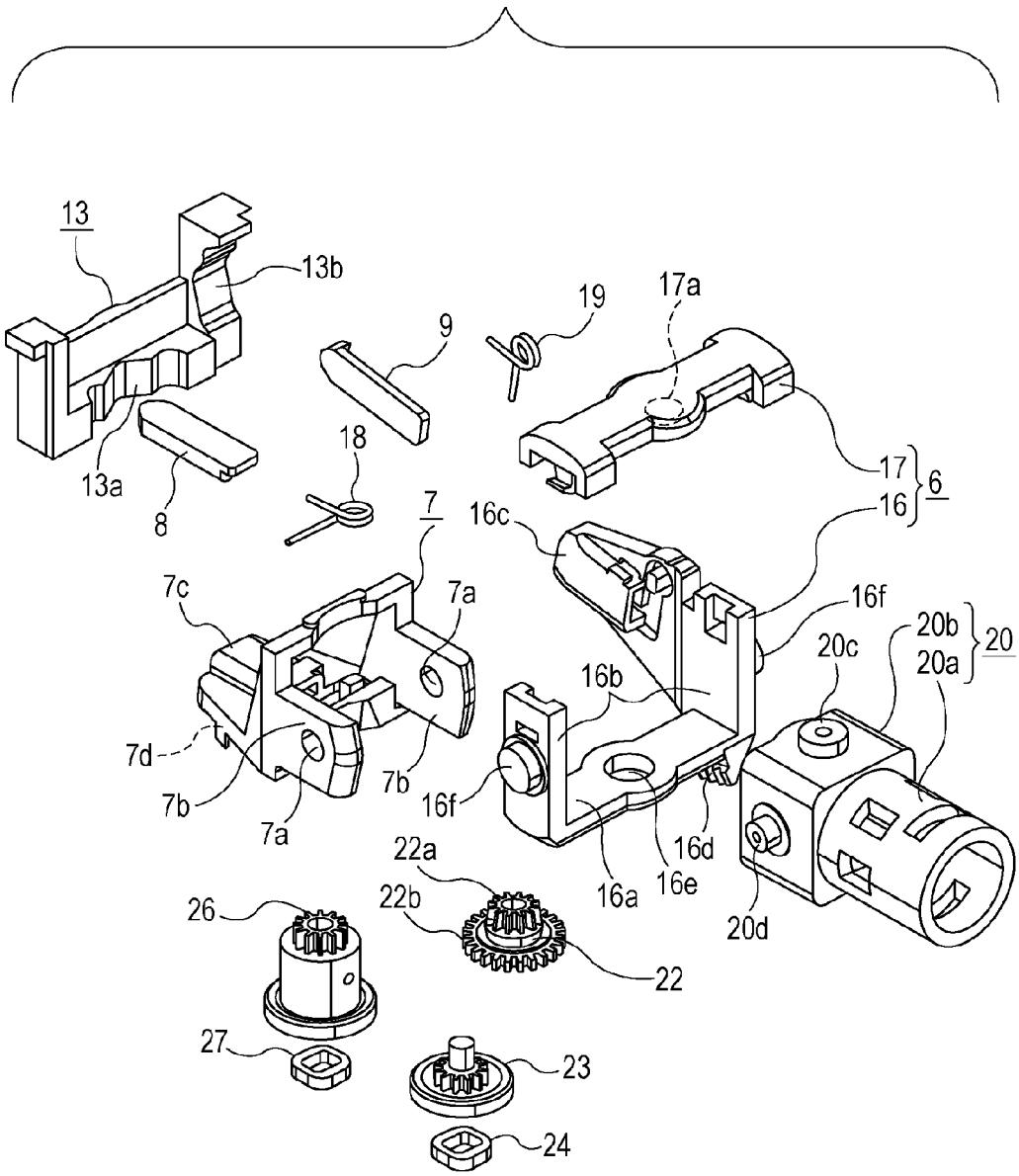
FIG. 5 is an exploded perspective view of the support mechanism illustrated in FIG. 3.
Figure 12:
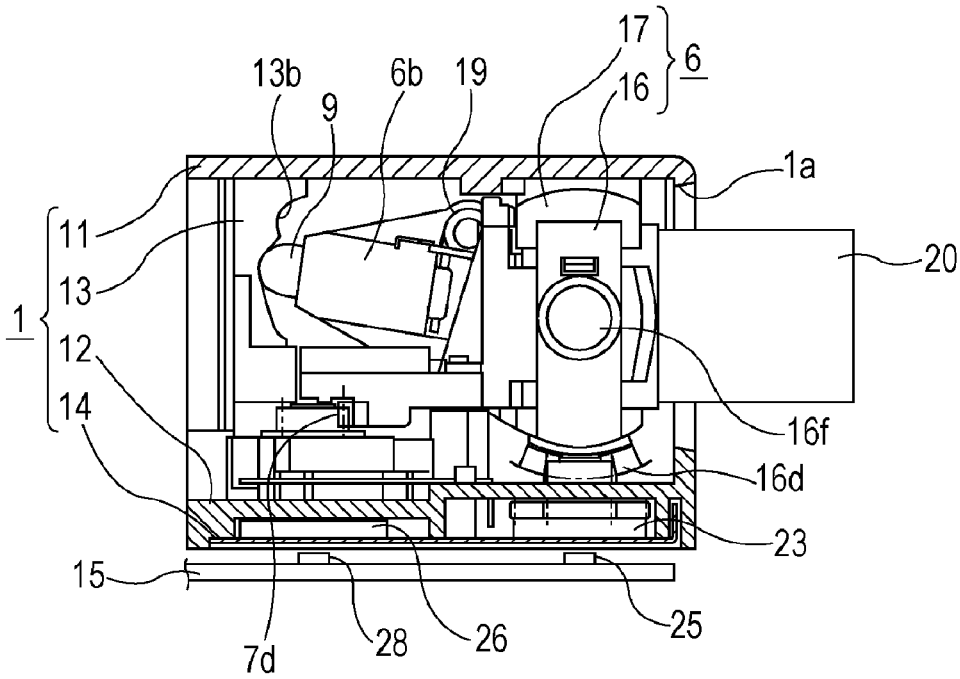
FIG. 12 is a diagram illustrating an engagement state of a second actuator when the operation lever is at a neutral position in the lever operation device.
Figure 13:
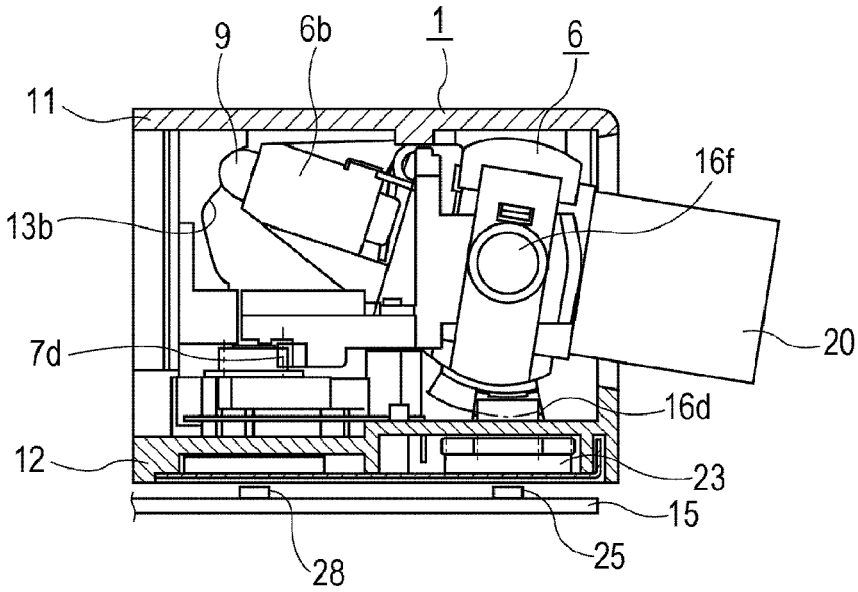
FIG. 13 is a diagram illustrating an engagement state of the second actuator when the operation lever is operated clockwise in FIG. 12.
Figure 14:
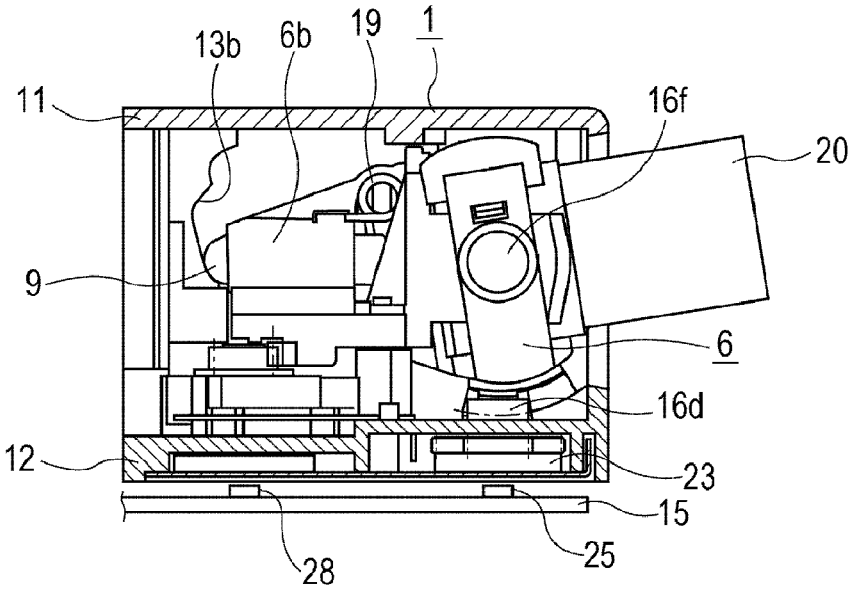
FIG. 14 is a diagram illustrating an engagement state of the second actuator when the operation lever is operated counterclockwise in FIG. 12.

The housing 1 is a box-shaped body formed by combining together an upper case 11, a lower case 12, a cam plate 13, and a bottom plate 14, which are illustrated in FIG. 2. The upper case 11 and the lower case 12 are snap-fitted together by fitting engagement claws 12*a* provided on the lower case 12 to engagement holes 11*a* formed in the upper case 11, so that an opening at the top of the lower case 12 is covered by the upper case 11. U-shaped cut sections 12*b* are formed in side wall portions of the lower case 12 at positions where the cut sections 12*b* are opposed to each other. The cut sections 12*b* function as bearing portions and support supporting shafts 16*f* of a movable support member 6, which will be described below, together with parts of inner walls (not shown) of the upper case 11 such that the supporting shafts 16*f* are rotatable. The cam plate 13 is fixed to an inner surface of a back wall portion 12*c* of the lower case 12. As illustrated in FIG. 5, the cam plate 13 is provided with a first cam surface 13*a* and a second cam surface 13*b* at different positions such that directions in which crests and troughs are arranged in the first and second cam surfaces 13*a* and 13*b* cross each other. The cam surfaces 13*a* and 13*b* define parts of an inner wall surface of the housing 1. An opening 1*a* (see FIGS. 9 and 12) is formed at a side of the housing 1 that is opposite to the back wall portion 12*c* when the upper case 11 and the lower case 12 are combined together. The operation lever 2 projects outward through the opening 1*a*. The bottom plate 14 is fixed to the lower case 12 so as to cover an opening at the bottom of the lower case 12. The bottom plate 14 has attachment holes 14*a* and 14*b* for attaching detection gears 23 and 26, which will be described below, at predetermined positions. As illustrated in FIGS. 12 to 14, a circuit board 15 is located near and parallel to the bottom plate 14, and magnetic sensors 25 and 28 are mounted on the circuit board 15.

A base portion 20 having a hollow structure, which is integrated with the operation lever 2, is disposed in the housing 1. The base portion 20 supports a base end portion of the operation lever 2, and is supported such that the base portion 20 is pivotable along two orthogonal directions by the structure illustrated in FIGS. 1 to 5. Referring to FIG. 5, the base portion 20 includes a cylindrical portion 20*a* to which the operation lever 2 is fitted; a rectangular-tube-shaped portion 20*b* that continues from the cylindrical portion 20*a*; a pair of first shafts 20*c* that project outward from two opposing walls of the rectangular-tube-shaped portion 20*b*; and a pair of second shafts 20*d* that project outward from the other two opposing walls of the rectangular-tube-shaped portion 20*b*. The axial center of the first shafts 20*c* and the axial center of the second shafts 20*d* are orthogonal to each other.

The operation lever 2 is supported such that the operation lever 2 is pivotable in two orthogonal directions by the movable support member 6, the bearing portions (cut sections 12*b*) of the housing 1, an actuator holder 7, a first actuator 8, and a second actuator 9. The movable support member 6 supports the base portion 20 of the operation lever 2 such that the base portion 20 is rotatable along a first operation plane P1 (plane orthogonal to the axial center of the first shafts 20*c*). The bearing portions support the movable support member 6 such that the movable support member 6 is rotatable along a second operation plane P2 that is orthogonal to the first operation plane P1 (plane orthogonal to the axial center of the supporting shafts 16*f*). The actuator holder 7 is attached to the base portion 20 such that the actuator holder 7 is pivotable along the second operation plane P2. The first actuator 8 is retained by the actuator holder 7 with a torsion spring (first elastic urging means) 18 provided therebetween. The second actuator 9 is retained by the movable support member 6 with a torsion spring (second elastic urging means) 19 provided therebetween. When the operation lever 2 is operated along the first operation plane P1, the movable support member 6 does not move. However, the actuator holder 7 rotates together with the base portion 20 along the first operation plane P1, so that only the first actuator 8 slides along the first cam surface 13*a*. When the operation lever 2 is operated along the second operation plane P2, the actuator holder 7 does not move, as described below. However, the movable support member 6 rotates together with the base portion 20 along the second operation plane P2, so that only the second actuator 9 slides along the second cam surface 13*b*. The first operation plane P1 is a plane that extends along the bottom plate 14 and the plane of FIGS. 9 to 11, and the second operation plane P2 is a plane that extends along the side wall portions of the housing 1 and the plane of FIGS. 12 to 14.

Figure 4:
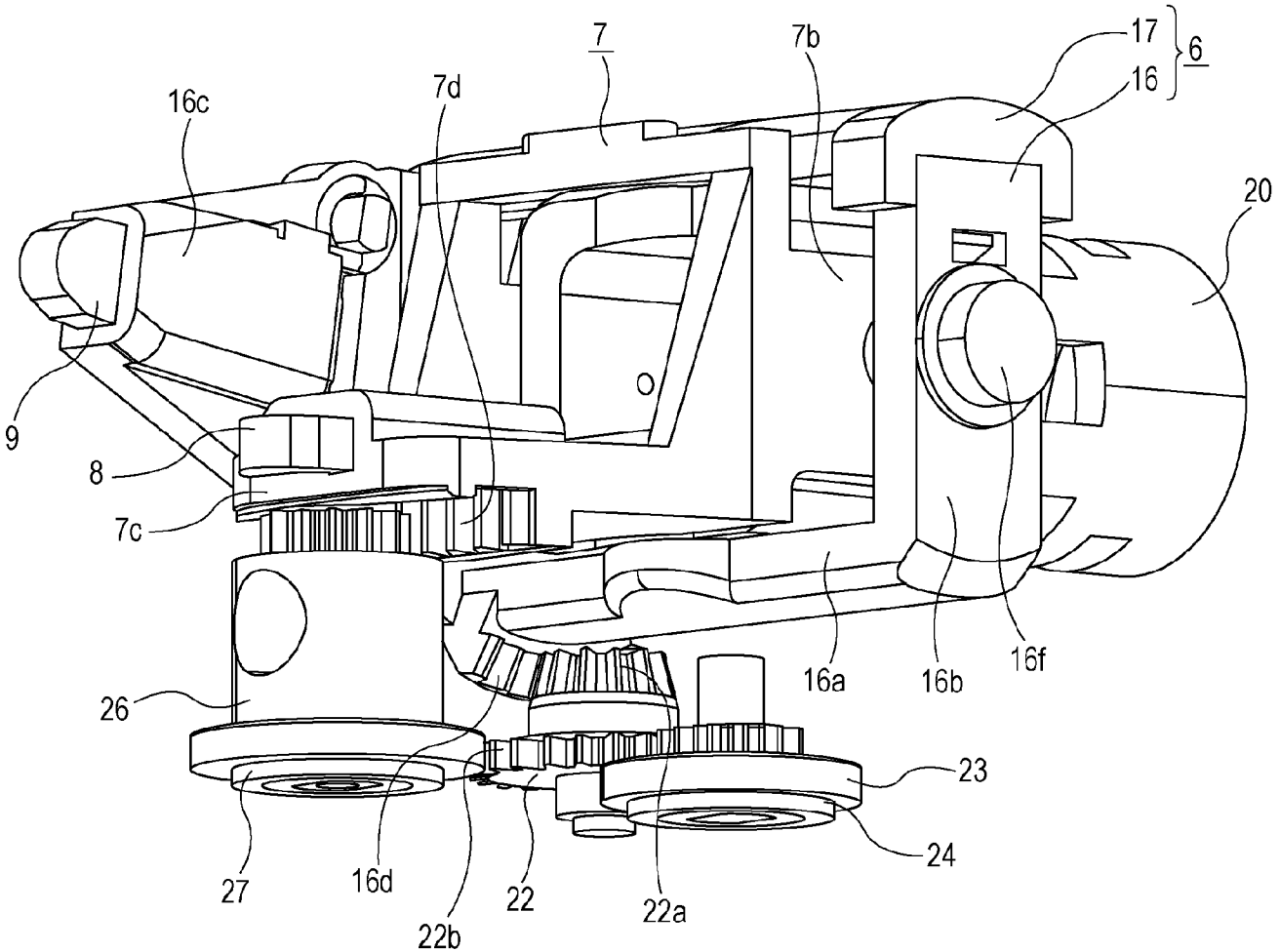
FIG. 4 is a perspective view of the support mechanism illustrated in FIG. 3 viewed from below.

The movable support member 6 is a hollow frame body formed by snap-fitting a base member 16 and a bridging plate 17 together. As illustrated in FIG. 5, the base member 16 includes a bottom portion 16*a*; a pair of side wall portions 16*b* that project in the same direction from the ends of the bottom portion 16*a*; an actuator-retaining portion (second retaining portion) 16*c* that projects toward the second cam surface 13*b* of the cam plate 13 from one of the side wall portions 16*b*; and a gear portion 16*d* that meshes with a relay gear 22 at the bottom side of the bottom portion 16*a*. A pair of bearing recesses 16*e* and 17*a* that support the pair of first shafts 20*c* on the base portion 20 in a rotatable manner are formed in the opposing surfaces of the bottom portion 16*a* and the bridging plate 17, respectively. The pair of supporting shafts 16*f* are formed so as to project outward from the outer surfaces of the side wall portions 16*b*, and are rotatably supported by the bearing portions (cut sections 12*b*) of the housing 1. The supporting shafts 16*f* serve as rotating shafts of the movable support member 6 with respect to the housing 1. The movable support member 6 attached to the housing 1 is rotatable around the axial center of the supporting shafts 16*f* along the second operation plane P2. The axial center of the supporting shafts 16*f* coincides with the axial center of the second shafts 20*d* on the base portion 20. The base portion 20 and the movable support member 6 can rotate together along the second operation plane P2 with the supporting shafts 16*f* serving as the rotating shafts. However, when the base portion 20 rotates along the first operation plane P1 with the first shafts 20*c* serving as the rotating shafts, the movable support member 6 does not rotate together with the base portion 20. The torsion spring 19 and the second actuator 9 are assembled to and retained by the actuator-retaining portion 16*c*. The second actuator 9 receives an urging force from the torsion spring 19 so that the second actuator 9 is constantly in elastic contact with the second cam surface 13*b*. As illustrated in FIG. 4, the gear portion 16*d* is formed as a part of a bevel gear. The gear portion 16*d* meshes with a small-diameter portion 22*a* of the relay gear 22, which is rotatable along the bottom plate 14, that is, rotatable such that the rotational axis of the relay gear 22 is orthogonal to the bottom plate 14. The detection gear 23, which is also rotatable along the bottom plate 14, meshes with a large-diameter portion 22*b* of the relay gear 22. Therefore, the gear portion 16*d* can rotate the detection gear 23 by rotating the relay gear 22 provided therebetween. More specifically, when the movable support member 6 rotates around the supporting shafts 16*f*, the rotational driving force is transmitted from the gear portion 16*d* to the relay gear 22, and the rotational direction is converted into a direction orthogonal thereto. Then, the relay gear 22 rotates the detection gear 23 at an increased rotational speed.

The relay gear 22 and the detection gear 23 are rotatably supported on the bottom plate 14 of the housing 1. A permanent magnet 24 is fixed to the bottom surface of the detection gear 23. The attachment position of the detection gear 23 is regulated by the attachment hole 14*a* in the bottom plate 14 such that the permanent magnet 24 faces the magnetic sensor 25 on the circuit board 15 at a position close thereto. A variation in magnetic field caused by a variation in the rotational position of the permanent magnet 24, which rotates together with the detection gear 23, is detected by the magnetic sensor 25. Thus, the rotational position of the movable support member 6, in other words, the operation position of the operation lever 2 along the second operation plane P2, can be accurately detected. The relay gear 22 is provided between the gear portion 16*d* and the detection gear 23 due to the following reason. That is, if the detection gear 23 and the gear portion 16*d* are configured so as to directly mesh with each other, an angular range within which the detection gear 23 can be rotated in response to the operation of the operation lever 2 would be extremely small compared to the maximum detection angular range of the magnetic sensor 25. To avoid this, the relay gear 22 is provided between the gear portion 16*d* and the detection gear 23 so as to increase the angular range of the detection gear 23 to a range close to the maximum detection angular range of the magnetic sensor 25, thereby allowing high-accuracy detection of the operation position of the operation lever 2 along the second operation plane P2.

As illustrated in FIG. 5, the actuator holder 7 includes a pair of attachment wall portions 7*b* which face each other and which each have a shaft hole 7*a*; an actuator-retaining portion (first retaining portion) 7*c* that projects in a direction opposite to the attachment wall portions 7*b*; and a gear portion 7*d* that meshes with the detection gear 26 at the bottom side of the retaining portion 7*c*. The shaft holes 7*a* in the attachment wall portions 7*b* receive the second shafts 20*d* on the base portion 20 in a rotatable manner. Thus, the actuator holder 7 is attached to the base portion 20 such that the actuator holder 7 is rotatable around the axial center of the second shafts 20*d*. In addition, the first actuator 8, which is constantly in elastic contact with the first cam surface 13*a*, receives a reaction force generated by the urging force of the torsion spring 18 from the first cam surface 13*a* and is restrained from sliding along the first cam surface 13*a*. Therefore, when the base portion 20 rotates along the second operation plane P2 with the supporting shafts 16*f* serving as the rotating shafts, the actuator holder 7 does not rotate together with the base portion 20. Instead, the movable support member 6 rotates along the second operation plane P2 together with the base portion 20, so that only the second actuator 9 slides along the second cam surface 13*b*. The actuator holder 7 rotates together with the base portion 20 only when the base portion 20 rotates along the first operation plane P1 with the first shafts 20*c* serving as the rotating shafts. The torsion spring 18 and the first actuator 8 are assembled to and retained by the actuator retaining portion 7*c*. The first actuator 8 receives the urging force from the torsion spring 18 so that the first actuator 8 is constantly in elastic contact with the first cam surface 13*a*. The gear portion 7*d* meshes with the detection gear 26 that is rotatable along the bottom plate 14. When the actuator holder 7 rotates along the first operation plane P1 together with the base portion 20, the rotational driving force is transmitted from the gear portion 7*d* to the detection gear 26, so that the detection gear 26 is rotated.

The detection gear 26 is supported on the bottom plate 14 of the housing 1, and a permanent magnet 27 is fixed to the bottom surface of the detection gear 26. The attachment position of the detection gear 26 is regulated by the attachment hole 14*b* in the bottom plate 14 such that the permanent magnet 27 faces the magnetic sensor 28 on the circuit board 15 at a position close thereto. A variation in magnetic field caused by a variation in the rotational position of the permanent magnet 27 which rotates together with the detection gear 26 is detected by the magnetic sensor 28. Thus, the rotational position of the actuator holder 7, in other words, the operation position of the operation lever 2 along the first operation plane P1, can be accurately detected.

Next, the operation lever 2, the internal structure thereof, and the operation members, such as the rotating knob 3, provided on the outer periphery of the operation lever 2 will be described. The operation lever 2 includes a pair of semicylindrical bodies 31 and 32 that are integrated with the base portion 20 and a cylindrical end cover 33 that is integrated with a distal end portion of a cylindrical body formed by combining the semicylindrical bodies 31 and 32. In the present embodiment, the semicylindrical bodies 31 and 32 are snap-fitted together, and the end cover 33 is snap-fitted to the semicylindrical bodies 31 and 32. The semicylindrical bodies 31 and 32 are bent at an intermediate position thereof. Accordingly, as illustrated in FIG. 1, the operation lever 2 has a cylindrical shape that includes a bent portion 2*a* and projects outward from the base portion 20.

Figure 7:
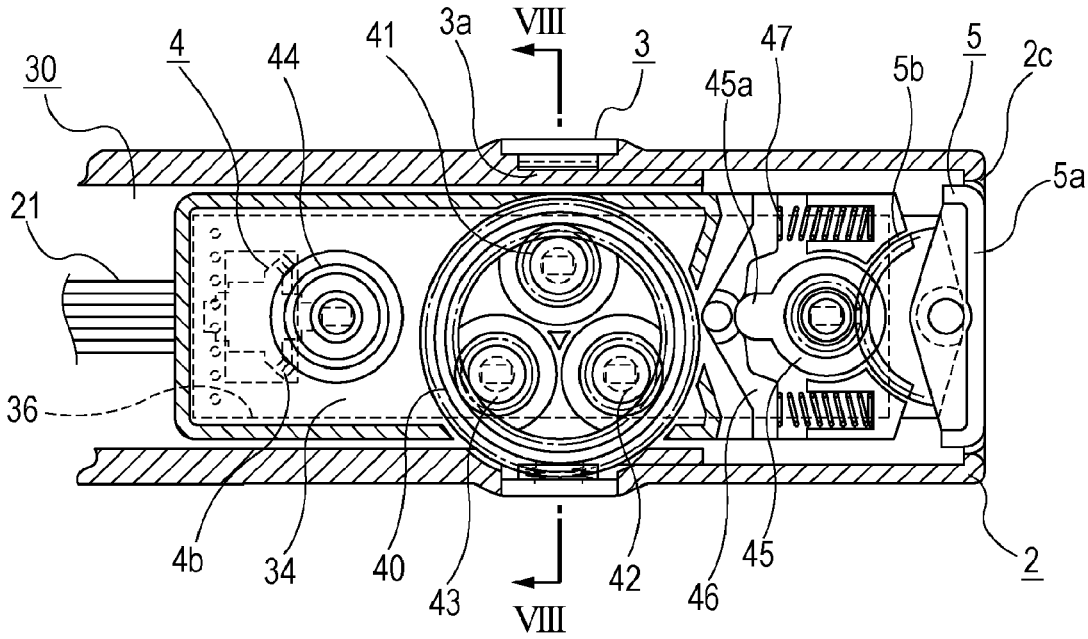
FIG. 7 is a diagram illustrating the internal structure of a distal end section of the operation lever included in the lever operation device.
Figure 8:
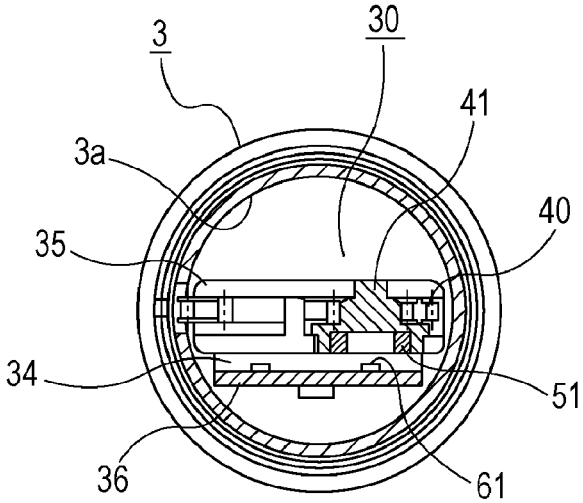
FIG. 8 is a sectional view of FIG. 7 taken along line VIII-VIII.

The operation lever 2 includes a substantially cylindrical portion 2*b* at the distal-end side of the bent portion 2*a*. The rotating knob 3 and the slide knob 4 are provided on the periphery of the substantially cylindrical portion 2*b*, and a locker knob 5 (see FIG. 7) is provided at the distal end of the substantially cylindrical portion 2*b*. A switch unit 30 is disposed in the substantially cylindrical portion 2*b* so as to extend in an axial direction thereof. As illustrated in FIG. 2, the switch unit 30 mainly includes a casing formed by combining a support case 34 and a cover case 35 together such that the support case 34 and the cover case 35 face each other; components such as gears 40 to 45, a cam lever 46, and coil springs 47 arranged in the casing; and a circuit board 36 provided so as to face the bottom surface of the support case 34. The switch unit 30 is disposed in the operation lever 2 such that the cases 34 and 35 and the circuit board 36 extend in the axial direction of the substantially cylindrical portion 2*b*. As illustrated in FIG. 7, a flat cable 21 is connected to the circuit board 36 and extends through the operation lever 2 to the inside of the housing 1.

The gear 40 is a ring gear having a large diameter, and the gears 41 to 43 are speed-increasing gears that mesh with the ring gear 40. The four gears 40 to 43 are arranged to serve as power transmitting means for the rotating knob 3. The gear 44 is arranged to serve as power transmitting means for the slide knob 4, and the gear 45, which is provided with an operating portion 45*a*, is arranged to serve as power transmitting means for the locker knob 5. Permanent magnets 51 to 55 are fixed to the bottom surfaces of the gears 41 to 45 excluding the ring gear 40. The permanent magnets 51 to 55 respectively face magnetic sensors 61 to 65 mounted on the circuit board 36 at positions close thereto. The support case 34 has a plurality of attachment holes 34*a* for attaching the gears 41 to 45 at predetermined positions, and the cover case 35 has a plurality of bearing holes 35*a* for supporting the shafts of the gears 41 to 45. The gears 41 to 45 are supported such that the gears 41 to 45 are rotatable along the circuit board 36, in other words, such that the rotational axes of the gears 41 to 45 are orthogonal to the circuit board 36. The ring gear 40 that meshes with the gears 41 to 43 so as to surround the gears 41 to 43 is also supported such that the gear 40 is rotatable along the circuit board 36.

Figure 6:
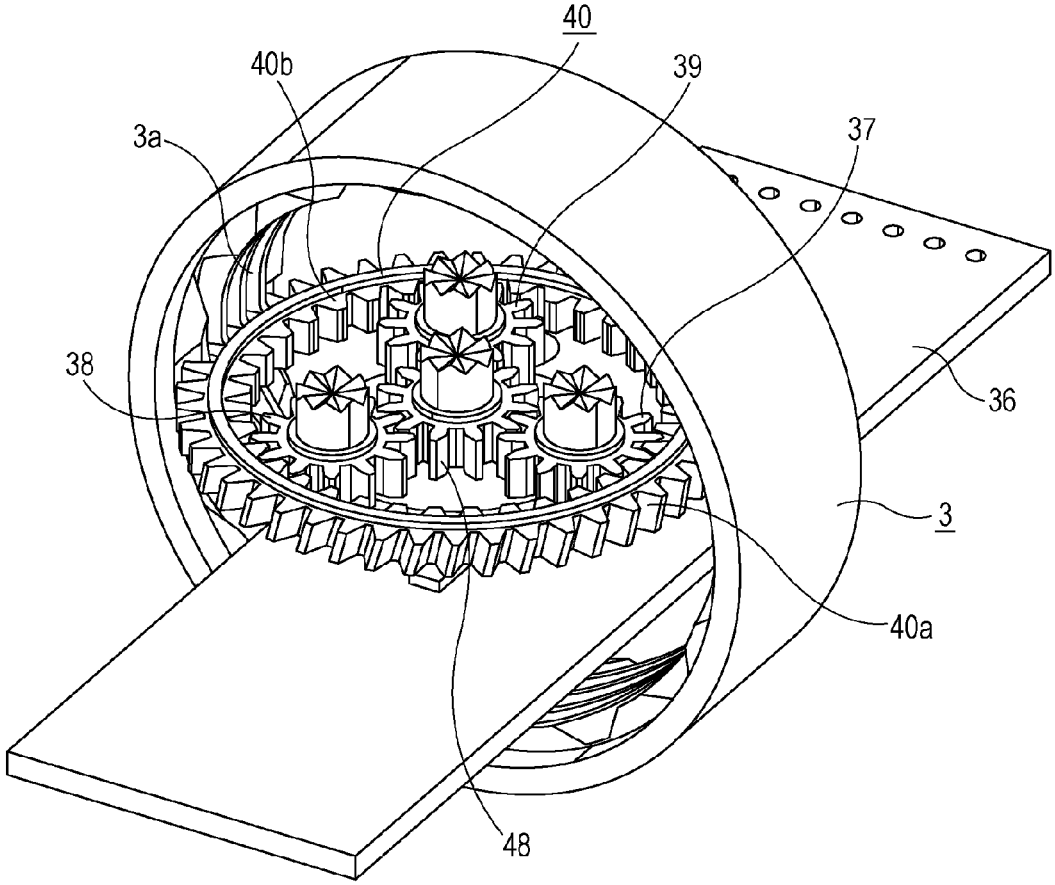
FIG. 6 is a perspective view of power transmitting means for a rotating knob included in the lever operation device.

The rotating knob 3 is externally fitted to stepped portions 31*a* and 32*a* formed on the semicylindrical bodies 31 and 32, respectively, and is supported such that the rotating knob 3 is rotatable within a predetermined angular range. Referring to FIG. 6, multiple lead portions 3*a* defined by a plurality of lead grooves are formed on the inner periphery of the rotating knob 3. The multiple lead portions 3*a* are formed as a lead thread portion for rotating the ring gear 40, and function as a worm gear when the rotating knob 3 is rotated. The multiple lead portions 3*a* on the rotating knob 3 mesh with external teeth 40*a* on the outer periphery of the ring gear 40. The plane orthogonal to the rotational axis of the rotating knob 3 and the plane orthogonal to the rotational axis of the ring gear 40 are orthogonal to each other. When the rotating knob 3 is rotated, the driving force is transmitted to the ring gear 40 while the rotational direction is changed to a direction orthogonal thereto. The ring gear 40 may be rotated by a desired rotational angle by appropriately setting the lead angle of the lead grooves. Internal teeth 40*b* that mesh with the speed-increasing gears 41 to 43 are provided on the inner periphery of the ring gear 40. When the ring gear 40 rotates, the speed-increasing gears 41 to 43 are driven so as to rotate in the same direction, so that the permanent magnets 51 to 53 also rotate together with the speed-increasing gears 41 to 43, respectively. Variations in magnetic fields caused by variations in the rotational positions of the permanent magnets 51 to 53 can be accurately detected by the magnetic sensors 61 to 63. The attachment positions of the speed-increasing gears 41 to 43 are defined by the corresponding attachment holes 34*a* in the support case 34. In the present embodiment, the three speed-increasing gears 41 to 43 are arranged along the inner periphery of the ring gear 40 with constant intervals therebetween, and have the same characteristics. The permanent magnets 51 to 53 fixed to the speed-increasing gears 41 to 43, respectively, also have the same magnetic characteristics. The magnetic sensors 61 to 63 that face the permanent magnets 51 to 53, respectively, at positions close thereto also have the same detection characteristics.

The slide knob 4 includes an operating portion 4*a* exposed at an opening 31*b* formed in the semicylindrical body 31, and is pivotally supported on the cover case 35 such that the operating portion 4*a* is slidable along the circumferential direction of the semicylindrical body 31. A gear portion 4*b*, which is a part of a bevel gear, is provided at one side of the slide knob 4. The gear portion 4*b* meshes with the gear 44, which is a detection gear. When the slide knob 4 is slid, the gear 44 is driven by the gear portion 4*b* so as to rotate along the circuit board 36, so that the permanent magnet 54 rotates together with the gear 44. A variation in magnetic field caused by a variation in the rotational position of the permanent magnet 54 can be accurately detected by the magnetic sensor 64. The attachment position of the gear 44 is regulated by the corresponding attachment hole 34*a* in the support case 34. In the present embodiment, the permanent magnet 54 have the same magnetic characteristics as those of the permanent magnets 51 to 53, and the magnetic sensor 64 have the same detection characteristics as those of the magnetic sensors 61 to 63.

The locker knob 5 includes an operating portion 5*a* exposed at an opening 2*c* (see FIG. 7) formed in the semicylindrical bodies 31 and 32 at the distal end thereof. The locker knob 5 is pivotally supported by distal end portions of the cases 34 and 35 such that the ends of the operating portion 5*a* in the longitudinal direction thereof can be selectively pressed toward the inside of the operation lever 2. A gear portion 5*b* is provided at the back side of the operating portion 5*a* of the locker knob 5, and the gear portion 5*b* meshes with the gear 45, which is a detection gear. When the ends of the locker knob 5 are selectively pressed, the gear 45 rotates together with the permanent magnet 55. A variation in magnetic field caused by a variation in the rotational position of the permanent magnet 55 can be accurately detected by the magnetic sensor 65. The gear 45 is provided with an operating portion 45*a*, and a clicking sensation is generated when the operating portion 45*a* moves over a crest of the cam surface of the cam lever 46. The cam lever 46 is rotatably retained by the cases 34 and 35, and the pair of coil springs 47 are interposed between the cam lever 46 and the locker knob 5. When the locker knob 5 is pressed, the locker knob 5 is caused to automatically return to the original position by the cam lever 46 and the coil springs 47. The attachment position of the gear 45 is regulated by the corresponding attachment hole 34*a* in the support case 34. In the present embodiment, the permanent magnet 55 have the same magnetic characteristics as those of the permanent magnets 51 to 54, and the magnetic sensor 65 have the same detection characteristics as those of the magnetic sensors 61 to 64.

In the present embodiment, annular magnets magnetized to N and S poles that are separated from each other by 180 degrees are used as the permanent magnets 24, 27, and 51 to 55, and giant magnetoresistive (GMR) sensors are used as the magnetic sensors 25, 28, and 61 to 65. However, the shapes and magnetization directions of the permanent magnets can be selected as appropriate, and MRE sensors, Hall elements, etc., may be used as the magnetic sensors.

Figure 9:
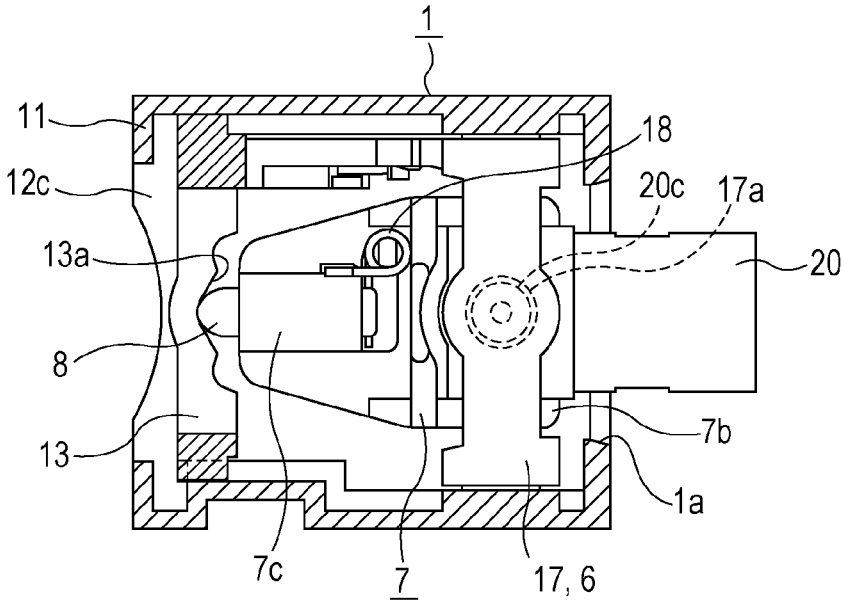
FIG. 9 is a diagram illustrating an engagement state of a first actuator when the operation lever is at a neutral position in the lever operation device.
Figure 10:
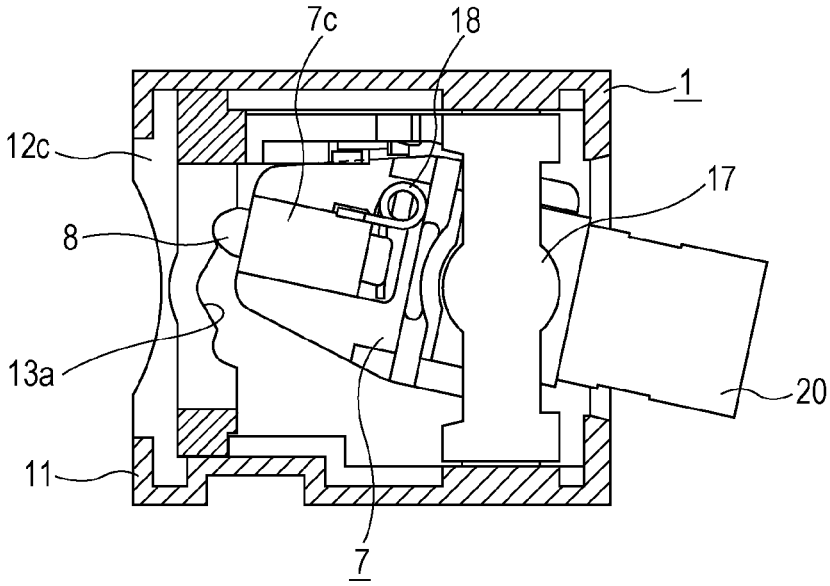
FIG. 10 is a diagram illustrating an engagement state of the first actuator when the operation lever is operated clockwise in FIG. 9.
Figure 11:
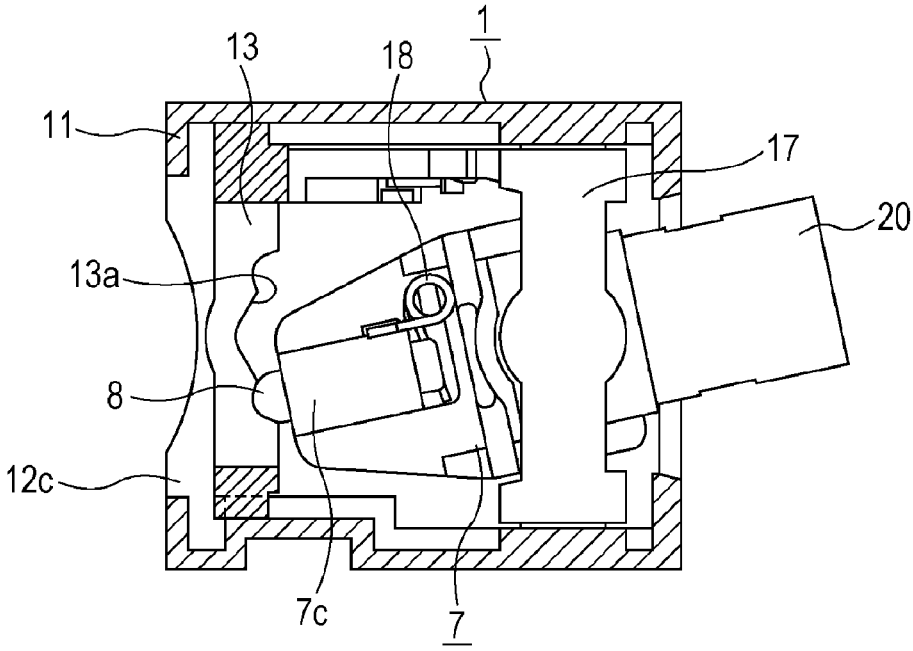
FIG. 11 is a diagram illustrating an engagement state of the first actuator when the operation lever is operated counterclockwise in FIG. 9.

The operation of the lever operation device having the above-described structure will now be described. First, the operation of the operation lever 2 will be described. FIGS. 9 and 12 illustrate the state in which the operation lever 2 is not pivoted in either direction and is retained at a neutral position. In this state, the first actuator 8 that is urged by the torsion spring 18 is in elastic contact with a trough of the first cam surface 13*a*, so that the actuator holder 7 is stably retained. In addition, the second actuator 9 that is urged by the torsion spring 19 is in elastic contact with a trough of the second cam surface 13*b*, so that the movable support member 6 is also stably retained.

When the operation lever 2 is pivoted from this state along the first operation plane P1, which is parallel to the plane of FIG. 9, the movable support member 6 does not move together with the base portion 20 of the operation lever 2, so that the second actuator 9 retained by the movable support member 6 does not slide along the second cam surface 13*b*. Accordingly, only the first actuator 8 retained by the actuator holder 7, which moves together with the base portion 20 of the operation lever 2, slides along the first cam surface 13*a*. Thus, the actuator holder 7 rotates together with the base portion 20, so that the first actuator 8 slides along the first cam surface 13*a* and the gear portion 7*d* rotates the detection gear 26. When the operation lever 2 is pivoted clockwise in FIG. 9, the first actuator 8 generates a clicking sensation by moving over one of the crests of the first cam surface 13*a*, and is restrained at an end of the first cam surface 13*a* immediately after the generation of the clicking sensation. Thus, the actuator holder 7 and the base portion 20 rotate to the position illustrated in FIG. 10, and are stopped. When the operation lever 2 is pivoted counterclockwise in FIG. 9, the first actuator 8 generates a clicking sensation by moving over the other one of the crests of the first cam surface 13*a*, and is restrained at the other end of the first cam surface 13*a* immediately after the generation of the clicking sensation. Thus, the actuator holder 7 and the base portion 20 rotate to the position illustrated in FIG. 11, and are stopped. In response to the rotation of the actuator holder 7 and the base portion 20, the detection gear 26 is rotated in a certain rotational direction by a certain amount. The variation in magnetic field caused by the variation in the rotational position of the permanent magnet 27 fixed to the detection gear 26 is detected by the magnetic sensor 28 (see FIGS. 12 to 14), so that the operation position of the operation lever 2 along the first operation plane P1 can be accurately detected. Accordingly, when the operation lever 2 is pivoted to the position illustrated in FIG. 10, a switch for flashing a right-turn lamp can be turned on in response to a detection signal output from the magnetic sensor 28. Similarly, when the operation lever 2 is pivoted to the position illustrated in FIG. 11, a switch for flashing a left-turn lamp can be turned on in response to a detection signal output from the magnetic sensor 28.

If the operation lever 2 retained at the neutral position is pivoted along the second operation plane P2, which is parallel to the plane of FIG. 12, the movable support member 6 rotates together with the base portion 20. Accordingly, the second actuator 9 slides along the second cam surface 13*b*, and the gear portion 16*d* rotates the detection gear 23 by rotating the relay gear 22 provided therebetween. However, as described above, the base portion 20 and the actuator holder 7 are connected to each other such that the base portion 20 and the actuator holder 7 can rotate individually along the second operation plane P2 instead of rotating together. In addition, the first actuator 8 retained by the actuator retaining portion 7*c* receives a reaction force from the first cam surface 13*a* with which the first actuator 8 is constantly in contact, and is restrained from sliding along the first cam surface 13*a*. Therefore, even when the operation lever 2 is pivoted along the second operation plane P2, the actuator holder 7 does not move together with the operation lever 2. When the operation lever 2 is pivoted clockwise in FIG. 12, only the second actuator 9 generates a clicking sensation by moving over the crest of the second cam surface 13*b*, and is restrained at an end of the second cam surface 13*b* immediately after the generation of the clicking sensation. Thus, the movable support member 6 and the base portion 20 rotate to the position illustrated in FIG. 13, and are stopped. When the operation lever 2 is pivoted counterclockwise in FIG. 12, the second actuator 9 is not restrained at the other end of the second cam surface 13*b*, as illustrated in FIG. 14. Accordingly, when the operating force is removed, the second actuator 9 is pushed back to the trough of the second cam surface 13*b*, and the movable support member 6 and the base portion 20 automatically return to the state illustrated in FIG. 12. In response to the rotation of the movable support member 6 and the base portion 20, the detection gear 23 is rotated in a certain rotational direction by a certain amount. The variation in magnetic field caused by the variation in the rotational position of the permanent magnet 24 fixed to the detection gear 23 is detected by the magnetic sensor 25, so that the operation position of the operation lever 2 along the second operation plane P2 can be accurately detected. Accordingly, when the operation lever 2 is pivoted to the position illustrated in FIG. 13, a switch for causing the headlights to aim higher can be turned on in response to a detection signal output from the magnetic sensor 25. Similarly, when the operation lever 2 is pivoted to the position illustrated in FIG. 14, a switch for making the headlights flash can be turned on in response to a detection signal output from the magnetic sensor 25.

Figure 15:
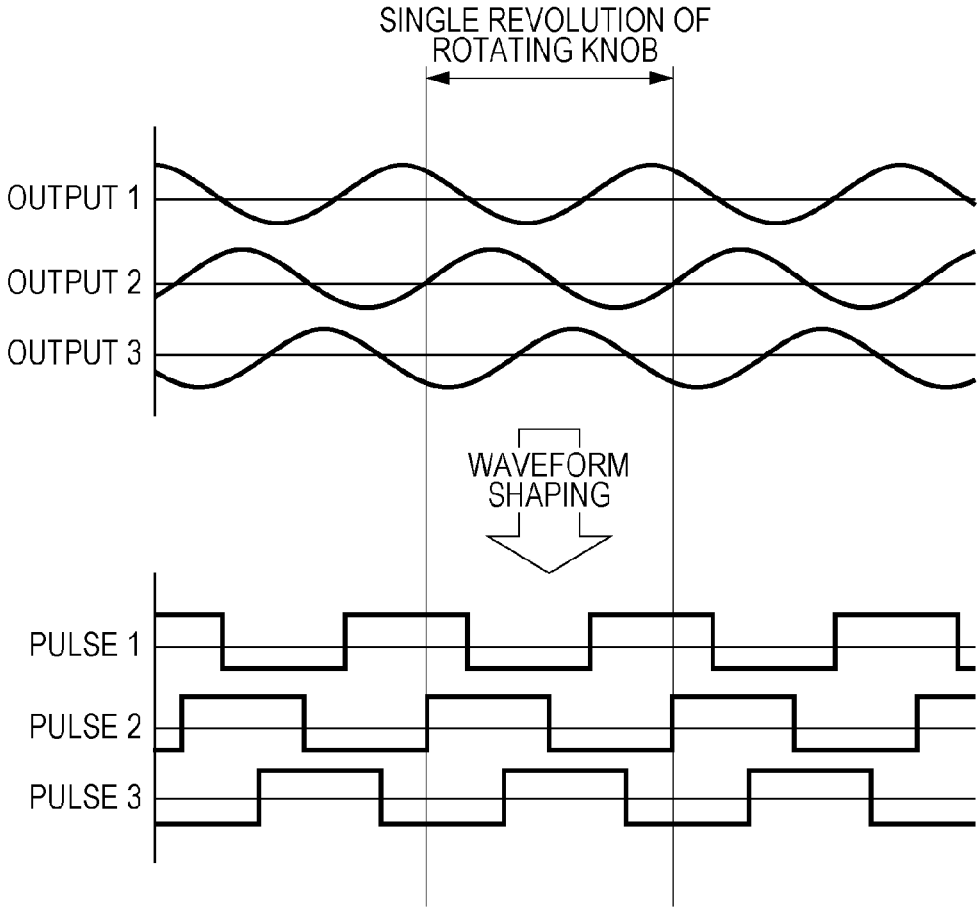
FIG. 15 is a diagram illustrating output waves output from a magnetic sensor for detecting an operation position of the rotating knob in the lever operation device.

Next, the operations performed when the operation members, such as the rotating knob 3, on the operation lever 2 are operated will be described. When the user rotates the rotating knob 3, the ring gear 40 is rotated by the multiple lead portions 3*a* formed on the inner periphery of the rotating knob 3. Accordingly, the speed-increasing gears 41 to 43 that mesh with the internal teeth 40*b* of the ring gear 40 rotate together with the permanent magnets 51 to 53, respectively, at an increased rotational speed. The rotational directions and the rotational angles of the speed-increasing gears 41 to 43 are determined by the rotational direction of the rotating knob 3 and the amount of rotation thereof. When variations in magnetic fields caused by variations in the rotational positions of the permanent magnets 51 to 53 are detected by the magnetic sensors 61 to 63, output waves illustrated in the upper part of FIG. 15 are obtained. The waves are shaped into pulse waves illustrated in the lower part of FIG. 15. Six operation positions of the rotating knob 3 within a single revolution thereof can be easily and accurately detected on the basis of the combination of the pulse waves. In other words, variations in the rotational positions of the permanent magnets 51 to 53 can be accurately detected by the magnetic sensors 61 to 63, respectively, and the rotating knob 3 can be used as a high-resolution rotary switch that has six detectable operation positions. However, if the number of operation positions of the rotating knob 3 to be detectable is not large, only one or two of the speed-increasing gears 41 to 43 may be provided with a permanent magnet fixed thereto.

When the user slides the slide knob 4, the permanent magnet 54 rotates together with the gear 44. The operation position of the slide knob 4 can be accurately detected by detecting the variation in magnetic field caused by the variation in the rotational position of the permanent magnet 54 with the magnetic sensor 64. Thus, the operation member can be used as a high-reliability slide switch.

When the user presses the locker knob 5, the permanent magnet 55 rotates together with the gear 45. The operation position of the locker knob 5 can be accurately detected by detecting the variation in magnetic field caused by the variation in the rotational position of the permanent magnet 55 with the magnetic sensor 65. Thus, the operation member can be used as a high-reliability seesaw switch. In addition, when the locker knob 5 is pressed and the gear 45 is rotated, the operating portion 45*a* rotates the cam lever 46 and the coil springs 47 are elastically compressed. Accordingly, when the operating force is removed, the cam lever 46 is operated in the opposite direction by the resilience force applied by the coil springs 47 and drives the operating portion 45*a* so as to rotate the gear 45 to the original rotational position.

As described above, the lever operation device according to the present embodiment includes the movable support member 6 that supports the base portion 20 of the operation lever 2 such that the base portion 20 is pivotable along the first operation plane P1; the housing 1 that supports the movable support member 6 such that the movable support member 6 is pivotable along the second operation plane P2 that is substantially orthogonal to the first operation plane P1; the actuator holder 7 attached to the base portion 20 of the operation lever 2 such that the base portion 20 is rotatable along the second operation plane P2; the first actuator 8 retained by the actuator holder 7 with the torsion spring (first elastic urging means) 18 provided therebetween; and the second actuator retained by the movable support member 6 with the torsion spring (second elastic urging means) 19 provided therebetween. The housing 1 is provided with the first cam surface 13*a* and the second cam surface 13*b*, the first actuator 8 and the second actuator 9 being in elastic contact with the first cam surface 13*a* and the second cam surface 13*b*, respectively. Thus, the first cam surface 13*a* and the second cam surface 13*b* along which the actuators 8 and 9 slide can be provided on the same face (inner wall surface) of the housing 1. Accordingly, the size of the lever operation device can be reduced by reducing the depth thereof. When the operation lever 2 is pivoted along the first operation plane P1, only the first actuator 8 slides along the first cam surface 13*a*. When the operation lever 2 is pivoted along the second operation plane P2, only the second actuator 9 slides along the second cam surface 13*b*. Thus, the first cam surface 13*a* and the second cam surface 13*b* can be provided at different positions on substantially the same face of the housing 1. With this structure, the clicking sensation (operation feeling) generated when the operation lever 2 is operated along the first operation plane P1 and the clicking sensation generated when the operation lever 2 is operated along the second operation plane P2 can be set along desired feeling curves without causing interference therebetween. Thus, a lever operation device having a good operation feeling can be provided. To reduce the size of the lever operation device by reducing the depth thereof, a common actuator may be cause to slide along a cam surface having the shape of a quadrangular pyramidal recess. However, in such a structure, contact areas in which an end portion of the actuator is in contact with the recess when the operation lever is operated along the first and second operation planes overlap in the central area of the recess. Therefore, there is a risk that the clicking sensations corresponding to the operation of the operation lever along the first operation plane and the operation of the operation lever along the second operation plane may be generated at the same time and interfere with each other.

In addition, according to the present embodiment, the actuator holder 7 includes the pair of attachment wall portions 7*b* that face each other and the actuator retaining portion 7*c* that projects in a direction opposite to the attachment wall portions 7*b* and that retains the first actuator 8. The second shafts 20*d* on the base portion 20 of the operation lever 2 are supported by the shaft holes 7*a* formed in the attachment wall portions 7*b*. The movable support member 6 includes a hollow frame body formed by combining the base member 16 that surrounds the attachment wall portions 7*b* and the bridging plate 17 together and the actuator-retaining portion 16*c* that projects in the same direction as the direction in which the actuator retaining portion 7*c* projects and that retains the second actuator 9. The bearing recesses 16*e* and 17*a* are formed in one of the two pairs of wall portions of the movable support member 6 that face each other, more specifically, in the opposing surfaces of the bottom portion 16*a* and the bridging plate 17. The first shafts 20*c* on the base portion 20 of the operation lever 2 are pivotally supported by the bearing recesses 16*e* and 17*a*. The supporting shafts 16*f* that project from the outer surfaces of the other one of the two pairs of wall portions, that is, the side wall portions 16*b*, are pivotally supported by the bearing portions (cut sections 12*b*) of the housing 1. Thus, the structure of the lever operation device can be made simpler, and the size thereof can be further reduced.

In the lever operation device according to the present embodiment, as is clear from FIGS. 12 to 14, the actuator holder 7 and the movable support member 6 are arranged next to each other. Therefore, the gear portion 7*d* at the bottom side of the actuator holder 7 and the gear portion 16*d* at the bottom side of the movable support member 6 are also disposed next to each other. As a result, the detection gears 26 and 23 are also disposed next to each other, and the permanent magnets 27 and 24 attached to the gears 26 and 23, respectively, are on the same plane. Thus, the magnetic sensors 28 and 25 corresponding to the permanent magnets 27 and 24, respectively, may be mounted on the common circuit board 15, and the size thereof can be reduced. Therefore, the space for the detection mechanism (the detection mechanism including the gear portions 7*d* and 16*d*, the detection gears 26 and 23, the permanent magnets 27 and 24, the magnetic sensors 28 and 25, and the circuit board 15) can be reduced and the size of the lever operation apparatus may be further reduced. When the operation lever 2 is pivoted along the first operation plane P1, the gear portion 7*d* of the actuator holder 7 rotates the detection gear 26, and the detection is carried out accordingly. When the operation lever 2 is pivoted along the second operation plane P2, the gear portion 16*d* of the movable support member 6 rotates the detection gear 23 and the detection is carried out accordingly. Therefore, the information regarding the pivoting operation of the operation lever 2 along the operation planes P1 and P2 can be accurately transmitted to the detection gears 26 and 23 by the gear portions 7*d* and 16*d*, respectively. Further, in the present embodiment, the permanent magnets 24 and 27 are attached to the detection gears 23 and 26, respectively, as objects to be detected, and the permanent magnets 24 and 27 rotate together with the detection gears 23 and 26, respectively, while facing the magnetic sensors 25 and 28, respectively, at positions close thereto. The operation position of the operation lever 2 can be detected extremely accurately by detecting the variations in magnetic fields caused by the variations in the rotational positions of the permanent magnets 24 and 27 with the magnetic sensors 25 and 28. Since the permanent magnets 24 and 27 do not contact the magnetic sensors 25 and 28, the continuity failure due to abrasion or the like can be prevented and the life of the device can be increased.

The present invention relates to the support structure of the operation lever, and the projecting shape of the operation lever, the operation members provided on the outer periphery of the operation lever, etc., may be arbitrarily selected.

What is claimed is:

1. A lever operation device comprising:

a movable support member that supports a base portion of an operation lever such that the base portion is pivotable along a first operation plane;

a housing that supports the movable support member such that the movable support member is pivotable along a second operation plane, the second operation plane being substantially orthogonal to the first operation plane;

an actuator holder attached to the base portion of the operation lever such that the actuator holder is rotatable along the second operation plane;

a first actuator retained by the actuator holder with first elastic urging means provided therebetween; and a second actuator retained by the movable support member with second elastic urging means provided therebetween, wherein the housing is provided with a first cam surface and a second cam surface, the first actuator and the second actuator being in elastic contact with the first cam surface and the second cam surface, respectively.

2. The lever operation device according to claim 1, further comprising:

a first rotating member rotated by a first driving portion provided on the actuator holder; and a second rotating member rotated by a second driving portion provided on the movable support member, wherein the first and second rotating members have respective objects to be detected and are attached to the housing, and wherein a circuit board on which detectors are mounted is attached to the housing, the detectors facing the objects to be detected.

3. The lever operation device according to claim 2, wherein the first and second driving portions are gear portions, the objects to be detected are permanent magnets, and the detectors are magnetic sensors.

4. The lever operation device according to claim 1, wherein the actuator holder includes a pair of attachment wall portions that face each other, and a first retaining portion that retains the first actuator, the first retaining portion projecting in a direction opposite to the attachment wall portions, wherein the attachment wall portions are pivotally attached to the base portion of the operation lever, and wherein the movable support member includes a hollow frame body that surrounds the attachment wall portions of the actuator holder, and a second retaining portion that retains the second actuator, the second retaining portion projecting from the hollow frame body in the same direction as the direction in which the first retaining portion projects, wherein one of two pairs of opposing wall portions of the frame body is pivotally attached to the base portion of the operation lever, and the other one of the two pairs of opposing wall portions is pivotally attached to the housing.

* * * * *